US011486082B2

(12) United States Patent
Noh et al.

(10) Patent No.: US 11,486,082 B2
(45) Date of Patent: Nov. 1, 2022

(54) DRYER AND CONTROLLING METHOD THEREOF

(71) Applicant: Samsung Electronics Co., Ltd., Suwon-si (KR)

(72) Inventors: Taegyoon Noh, Suwon-si (KR); Doyoon Kim, Suwon-si (KR); Dohaeng Kim, Suwon-si (KR); Hoyoung Kim, Suwon-si (KR); Junhoe Choi, Suwon-si (KR); Jeongsu Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 175 days.

(21) Appl. No.: 17/078,403

(22) Filed: Oct. 23, 2020

(65) Prior Publication Data

US 2021/0123184 A1 Apr. 29, 2021

(30) Foreign Application Priority Data

Oct. 25, 2019 (KR) ..... 10-2019-0134038

(51) Int. Cl.

| | |
|---|---|
| ***D06F 58/38*** | (2020.01) |
| ***D06F 58/22*** | (2006.01) |
| ***D06F 58/02*** | (2006.01) |
| ***D06F 103/34*** | (2020.01) |

(52) U.S. Cl.

CPC ..... *D06F 58/38* (2020.02); *D06F 58/02* (2013.01); *D06F 58/22* (2013.01); *D06F 2103/34* (2020.02)

(58) Field of Classification Search

CPC ..... D06F 58/38; D06F 58/02; D06F 58/22; D06F 2103/34

USPC ..... 34/497, 595–610

See application file for complete search history.

(56) References Cited

U.S. PATENT DOCUMENTS 3,099,542 A * 7/1963 Van Scoyk ..... D06F 58/30 34/554
5,159,766 A * 11/1992 Henig ..... F26B 21/08 34/604
5,546,678 A * 8/1996 Dhaemers ..... F26B 21/02 34/224

(Continued)

FOREIGN PATENT DOCUMENTS

EP 2383385 B1 * 5/2014 ..... D06F 58/28
KR 10-0595520 7/2006

(Continued)

*Primary Examiner* — Stephen M Gravini
(74) *Attorney, Agent, or Firm* — Staas & Halsey LLP

(57) ABSTRACT

A dryer is disclosed. The dryer includes a heat exchanger configured to remove moisture from air flowing and heat and discharge the moisture-removed air, a drum containing a material to be dried, a humidity sensor configured to detect a humidity of the air flowing from the drum, a fan configured to generate a flow of the air flowing along a flow path formed so that the air discharged from the heat exchanger flows to the heat exchanger via the drum and the humidity sensor, and a processor configured to determine a dried state of the material to be dried based on the humidity detected through the humidity sensor, and the humidity sensor is disposed at a position where a flow velocity of the air is equal to or higher than a predetermined velocity in the flow path formed between the drum and the heat exchanger.

16 Claims, 13 Drawing Sheets

(56) References Cited

U.S. PATENT DOCUMENTS

| | | | | |
|---|---|---|---|---|
| 8,863,400 | B2 * | 10/2014 | Ahn | D06F 58/206 34/607 |
| 9,091,014 | B2 | 7/2015 | Park et al. | |
| 9,200,840 | B2 * | 12/2015 | Choi | F26B 21/06 |
| 9,249,539 | B2 | 2/2016 | Hubig et al. | |
| 9,356,542 | B2 * | 5/2016 | Ragogna | D06F 58/36 |
| 9,745,690 | B2 * | 8/2017 | Lee | D06F 58/38 |
| 9,834,882 | B2 * | 12/2017 | Patil | D06F 58/206 |
| 10,087,570 | B2 | 10/2018 | Santillan Galvan | |
| 10,100,460 | B2 * | 10/2018 | Bisaro | D06F 58/34 |
| 10,450,692 | B2 * | 10/2019 | Wu | D06F 58/38 |
| 10,612,184 | B2 * | 4/2020 | Owejan | D06F 58/20 |
| 10,914,033 | B2 * | 2/2021 | Kim | D06F 58/26 |
| 11,008,697 | B2 * | 5/2021 | Masters | D06F 58/30 |
| 11,060,236 | B2 * | 7/2021 | Djerekarov | D06F 58/30 |
| 11,248,334 | B2 * | 2/2022 | Vitali | D06F 58/38 |
| 11,346,043 | B2 * | 5/2022 | Prajescu | D06F 58/38 |
| 11,352,736 | B2 * | 6/2022 | Seok | D06F 58/26 |
| 2005/0044744 | A1 * | 3/2005 | Tadano | D06F 58/206 34/596 |
| 2005/0066538 | A1 * | 3/2005 | Goldberg | D06F 34/26 34/218 |
| 2005/0092035 | A1 * | 5/2005 | Shin | D06F 39/008 68/275 |
| 2006/0179676 | A1 * | 8/2006 | Goldberg | D06F 25/00 68/3 R |
| 2008/0235977 | A1 * | 10/2008 | Kuwabara | D06F 58/206 134/105 |
| 2010/0275779 | A1 * | 11/2010 | Melikyan | C02F 9/005 96/396 |
| 2021/0123184 | A1 * | 4/2021 | Noh | D06F 58/22 |
| 2021/0156073 | A1 * | 5/2021 | Kim | D06F 58/04 |
| 2022/0170194 | A1 * | 6/2022 | Ahn | D06F 58/02 |
| 2022/0170199 | A1 * | 6/2022 | Cha | D06F 58/26 |

FOREIGN PATENT DOCUMENTS

| | | | | |
|---|---|---|---|---|
| KR | 10-2011-0080620 | | 7/2011 | |
| KR | 10-1667713 | | 10/2016 | |
| WO | WO-2020108918 | A1 * | 6/2020 | D06F 58/24 |

* cited by examiner

DRYER AND CONTROLLING METHOD THEREOF

CROSS-REFERENCE TO RELATED APPLICATION

This application is based on and claims priority under 35 U.S.C. § 119 to Korean Patent Application No. 10-2019-0134038, filed on Oct. 25, 2019, in the Korean Intellectual Property Office, the disclosure of which is incorporated by reference herein in its entirety.

BACKGROUND

1. Field

The disclosure relates to a dryer and a controlling method thereof, and more particularly relates to a dryer which determines a dried state of a material to be dried using a humidity sensor and a controlling method thereof.

2. Description of Related Art

In general, a dryer is a device which performs drying and disinfection by rotating a drum containing a wet material to be dried, for example, clothes, and applying hot air to the material to be dried for a certain period of time.

In the dryer, an electrode sensor was used in the related art, in order to measure a dryness degree of the material to be dried. FIGS. 1A and 1B are diagrams illustrating operation principles of the electrode sensor.

Referring to FIG. 1A, when wet clothes come into contact with an electrode 1 and an electrode 2, a current flows from the electrode 1 to the electrode 2 via the wet clothes. However, referring to FIG. 1B, when dried clothes come into contact with the electrode 1 and the electrode 2, the current may not flow between the two electrodes.

With such principles, in the related art, the number of times of electric connection between the two electrodes due to the contact of the material to be dried with the two electrodes was periodically measured, and when a value thereof was equal to or smaller than a predetermined value, the material to be dried was determined to be dried.

Meanwhile, in the measurement method using the electrode sensor as described above, the contact between the electrode sensor and the material to be dried is essential. However, since a drum containing the material to be dried rotates, a position of the electrode sensor is limited.

FIG. 1C is a diagram of an example in which the electrode sensor is applied to a dryer. FIG. 1C illustrates a view of a door side from the inside of the drum. Referring to FIG. 1C, the electrode sensor is normally disposed in front of the drum on a structure separated from the drum and not rotating.

As described above, in the related art, the dryness degree is measured through the physical contact between the electrode sensor installed in front of the drum and the material to be dried. Accordingly, it was difficult to measure a dryness degree of all of materials to be dried contained in the drum, particularly, materials to be dried rotating in a rear portion of the drum. Therefore, even if the materials to be dried in the rear portion of the drum are not dried yet, dried clothes in a front portion of the drum may come into contact with the electrode sensor to cause erroneously determination of the completion of clothes drying.

In order to solve such a problem, a method for applying a certain period of additional drying time unconditionally without detecting the dryness degree after the materials to be dried are dried to some extent is used, but this also has a problem regarding overdrying or an increase in drying time.

Accordingly, in order to solve such a problem, a method for measuring the dryness degree of the materials to be dried using a humidity sensor may be considered. When using the humidity sensor, the dryness degree is determined by measuring a humidity due to the materials to be dried, and accordingly, it is possible to grasp an accurate dryness degree without physical contact with the materials to be dried.

However, in the case of the humidity sensor, it is necessary to provide a hole for a contact between a humidity detection film (or humidity detection material) in the humidity sensor and the air containing moisture, and foreign materials (e.g., dust, lint, and the like) generated from the materials to be dried may be accumulated in the hole of the humidity sensor during a drying process of the dryer, thereby preventing smooth humidity detection of the humidity sensor.

SUMMARY

In accordance with an aspect of the disclosure, there is provided a dryer including a heat exchanger configured to remove moisture from air flowing and heat and discharge the moisture-removed air, a drum containing a material to be dried, a humidity sensor configured to detect a humidity of the air flowing from the drum, a fan configured to generate a flow of the air flowing along a flow path formed so that the air discharged from the heat exchanger flows to the heat exchanger via the drum and the humidity sensor, and a processor configured to determine a dried state of the material to be dried based on the humidity detected through the humidity sensor, in which the humidity sensor is disposed at a position where a flow velocity of the air is equal to or higher than a predetermined velocity in the flow path formed between the drum and the heat exchanger.

In accordance with another aspect of the disclosure, there is provided a method for controlling a dryer in which a flow path is formed so that air discharged from a heat exchanger flows to the heat exchanger via a drum and a humidity sensor, the method including detecting a humidity of the air flowing from the drum containing a material to be dried through the humidity sensor, and determining a dried state of the material to be dried based on the detected humidity, in which the humidity sensor is disposed at a position where a flow velocity of the air is equal to or higher than a predetermined velocity in the flow path formed between the drum and the heat exchanger.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

Figure 1A:
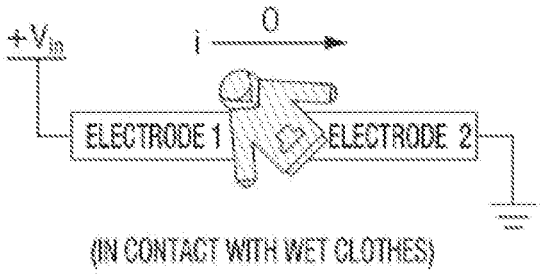
FIG. 1A is a diagram illustrating operation principles of an electrode sensor.
Figure 1B:
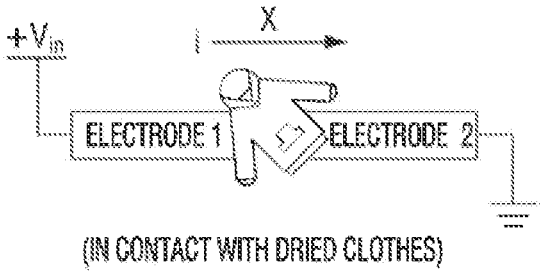
FIG. 1B is a diagram illustrating operation principles of the electrode sensor.
Figure 1C:
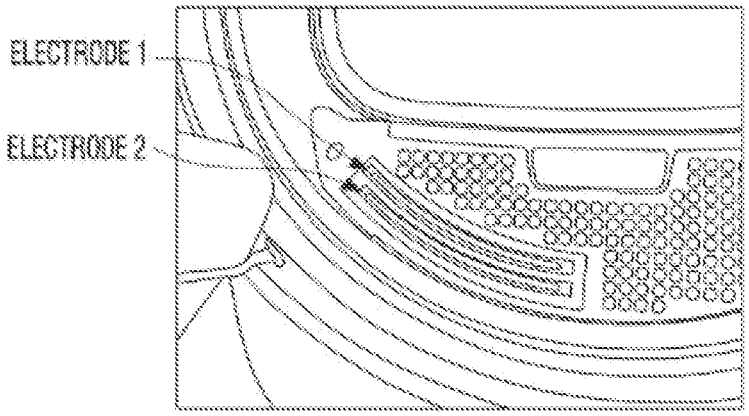
FIG. 1C is a diagram of an example in which the electrode sensor is applied to a dryer.

An object of the disclosure is to provide a dryer which accurately determine a dried state of a material to be dried using a humidity sensor and a method for controlling the same. Specifically, the object of the disclosure is to provide a dryer capable of overcoming a positional limitation of an electrode sensor using a humidity sensor and solving a problem occurring when applying the humidity sensor, and a method for controlling the same.

The terms used in embodiments of the disclosure have been selected as widely used general terms as possible in consideration of functions in the disclosure, but these may vary in accordance with the intention of those skilled in the art, the precedent, the emergence of new technologies and the like. In addition, in a certain case, there may also be an arbitrarily selected term, in which case the meaning will be described in the description of the disclosure. Therefore, the terms used in the disclosure should be defined based on the meanings of the terms themselves and the contents throughout the disclosure, rather than the simple names of the terms.

When it is described that a certain part "includes" another certain part, it implies that a still another part may be further included, rather than excluding it, unless otherwise noted. A term such as "-or/er" or a "module" in the disclosure may refer to a unit processing at least one function or operation, and may be implemented as hardware, software, or a combination of hardware and software.

Hereinafter, embodiments of the disclosure will be described in detail with reference to the accompanying drawings. The embodiments below will be described based on most preferred embodiments for understanding technical features of the disclosure, and the technical features of the disclosure are not limited by the embodiments which will be described below, but the disclosure may be implemented with the embodiments which will be described below.

Therefore, various modifications can be performed within a technical scope of the disclosure with the embodiments which will be described below and such modification embodiments may be considered to belong to the technical scope of the disclosure. In reference numerals in the accompanying drawings denoted for the understanding of embodiments which will be described below, the same number or continued number are denoted for related elements operating in the same manner among elements in each embodiment. Further, the accompanying drawings do not illustrate with actual scale and may illustrate enlarged dimensions of some elements.

A dryer 100 (or clothes dryer) described below is a device which dries a material to be dried by supplying hot dry air at a high temperature to a drying chamber containing the material to be dried, and the material to be dried may include everything which is able to be dried and disinfected through hot air. For example, the material to be dried may include, without limitation, materials implemented as various types of fibers and fabric such as a textile, clothes, a towel, a blanket, and the like.

Hereinafter, various embodiments of the disclosure will be described in detail with reference to the accompanying drawings.

Figure 2A:
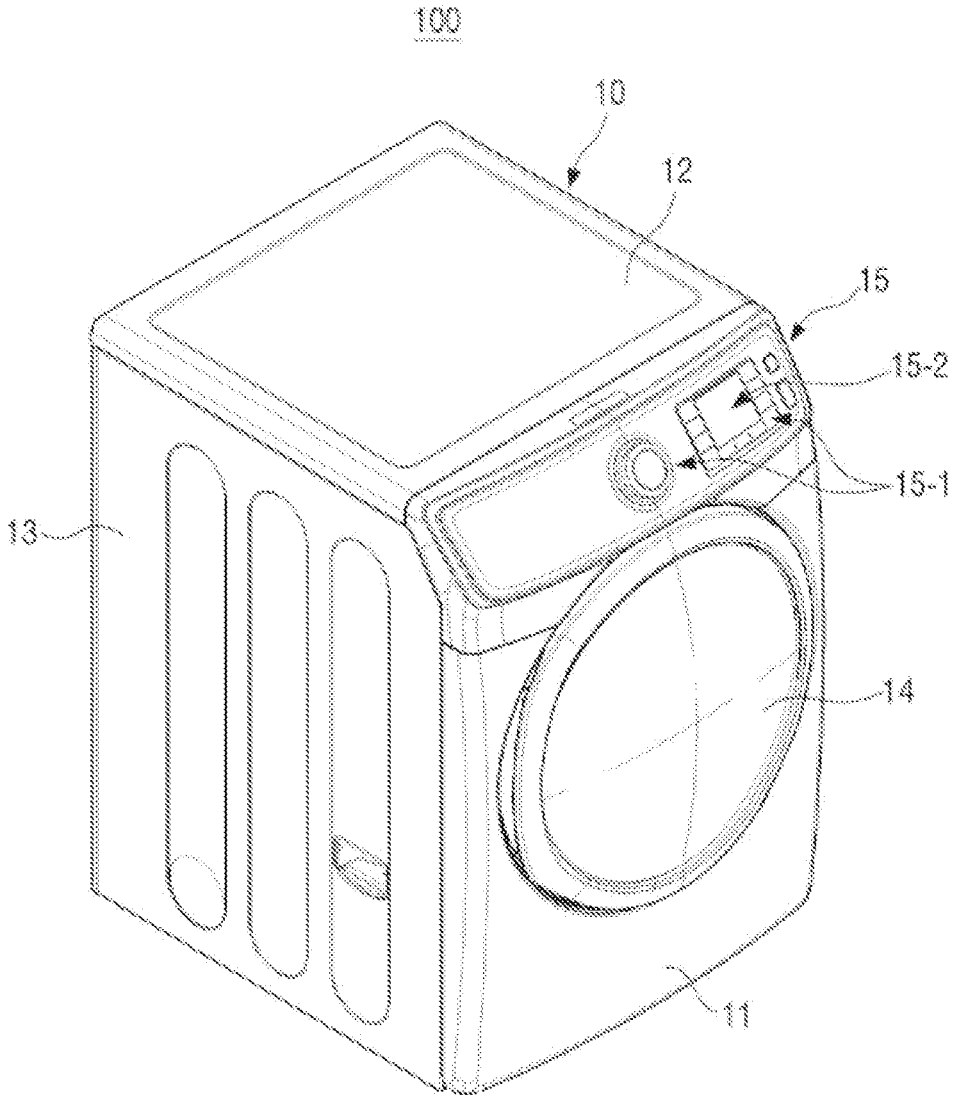
FIG. 2A is a perspective view of a dryer according to an embodiment.

FIG. 2A is a perspective view of a dryer according to an embodiment. Referring to FIG. 2A, the dryer 100 may include a main body 10 forming an appearance. The main body 10 may have a rectangular shape extending in a vertical direction. However, this is merely an embodiment for convenience of description and the main body 10 may be implemented in various shapes.

The main body 10 may include a front panel 11, an upper panel 12, and a side and rear panel 13.

The main body 10 may include an opening 10H formed at one side (see FIG. 2B), and the opening 10H may be formed on the front panel 11 to be open towards a portion ahead of the main body 10. In this case, the main body 10 may be combined with a door 14 to open and close the opening 10H.

In addition, a control panel 15 may be disposed on an upper portion of the front panel 11.

The control panel 15 may include a manipulation part 15-1 for receiving a manipulation command for an operation of the dryer 100 and a display 15-2 for displaying operation information of the dryer 100.

In this case, a user may input various user commands for operating the dryer 100 via the manipulation part 15-1. For this, the manipulation part 15-1 may include buttons, manipulation dials, and the like.

For example, the user may select a desired course (or process) via buttons or manipulation dials provided in the manipulation part 15-1.

The display 15-2 may display operation information of the dryer 100 as a visual image. The display 15-2 may be configured as a touch screen for receiving a manipulation command of the user.

Figure 2B:
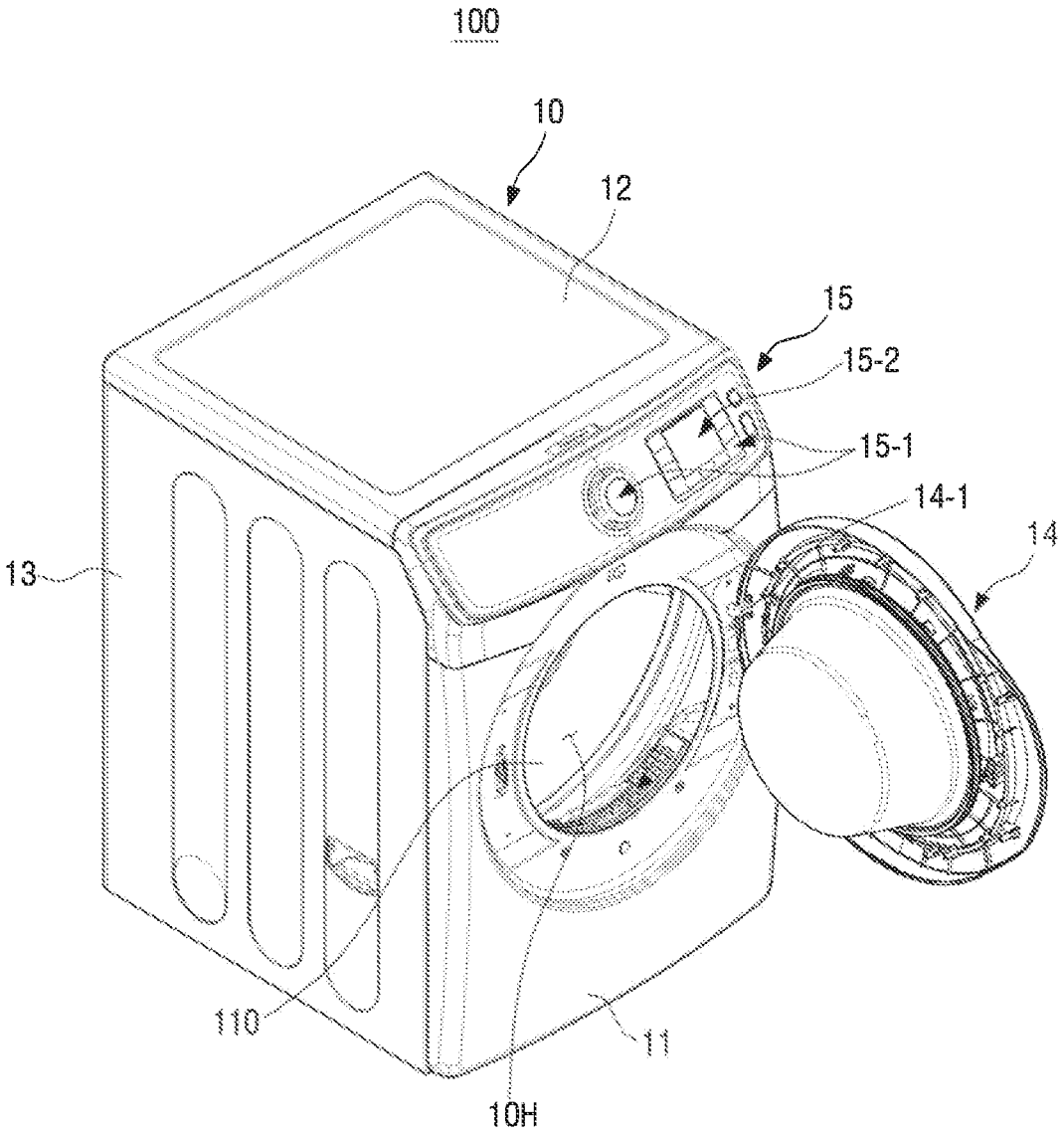
FIG. 2B is a perspective view of the dryer of FIG. 2A with an open door.

FIG. 2B is a perspective view illustrating the dryer 100 illustrated in FIG. 2A with the open door 14.

Referring to FIG. 2B, the opening 10B may be formed at one side of the main body 10 and the opening 10H may be formed on the front panel 11 to have a circular shape.

A drum 110 may be rotatably disposed in the main body 10, and the drum 110 may be connected to the opening 10H so that the material to be dried is inserted therein through the opening 10H.

Specifically, the drum 110 may include a drying chamber (not illustrated) connected to the opening 10H, and the material to be dried inserted to the drying chamber (not illustrated) through the opening 10H may be dried by hot air flowing into the drying chamber (not illustrated).

Meanwhile, a motor (not illustrated) may be provided in the main body 10 and the drum 110 may rotate in accordance with rotation of the motor (not illustrated). Accordingly, the material to be dried inserted into the drying chamber (not illustrated) may be tumbled so that the hot air is uniformly applied to the material to be dried.

The door 14 is combined with the front panel 11 of the main body 10 to open and close the opening 10H.

The door 14 may be combined with the front panel 11 to pivot, thereby opening and closing the opening 10H.

Specifically, referring to FIG. 2B, a hinge 14-1 may be disposed at one side of the front panel 11 adjacent to the opening 10H, and the door 14 may be connected to the hinge 14-1 and rotate around the hinge 14-1, thereby opening and closing the opening 10H.

The door 14 may have a circular shape corresponding to the shape of the opening 10H and may be formed to have a greater diameter than that of the opening 10H. Accordingly, when the door 14 is open, the material to be dried may be inserted into the drying chamber (not illustrated) of the drum 110 through the opening 10H.

Figure 3:
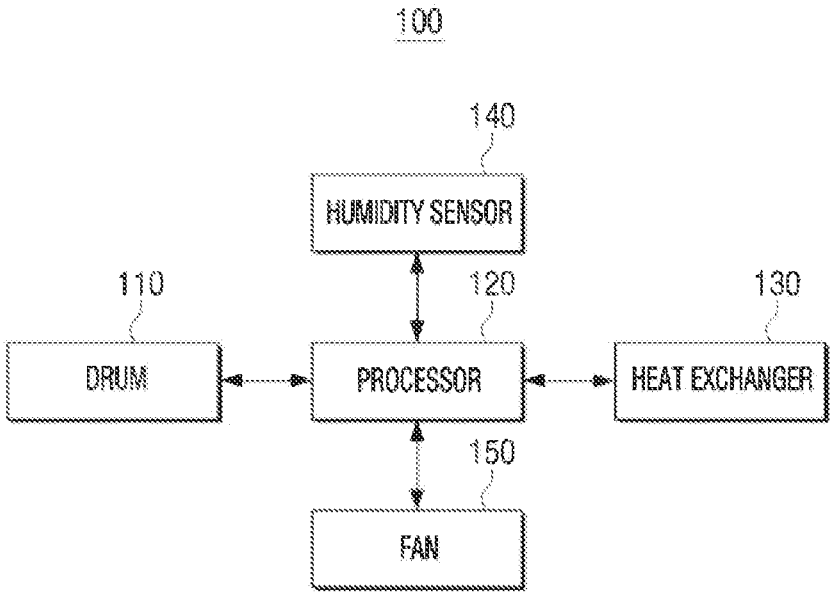
FIG. 3 is a block diagram of the dryer according to an embodiment.

FIG. 3 is a block diagram of the dryer according to an embodiment.

Referring to FIG. 3, the dryer 100 may include the drum 110, a processor 120, a heat exchanger 130, a humidity sensor 140, and a fan 150.

The fan 150 may generate a flow of the air flowing along a flow path formed in the dryer. The flow path may be formed in the dryer so that the air discharged from the heat exchanger 130 passes through the drum 110 and the humidity sensor 140 and then flow to the heat exchanger again.

The drum 110 may contain the material to be dried. For this, the drum 110 may include the drying chamber (not illustrated) for containing the material to be dried and the material to be dried may be dried with the air flowing into the drying chamber (not illustrated). In this case, the drum 110 may be rotatably disposed and the material to be dried inserted into the drying chamber (not illustrated) may be tumbled in accordance with the rotation of the drum 110 and the air may be uniformly applied to the material to be dried.

The heat exchanger 130 may remove moisture from the air flowing therein and heat and discharge the moisture-removed air. Specifically, the heat exchanger 130 may remove moisture by condensing the air with a lot of moisture flowing from the drum 110 and expand the moisture-removed air to heat the air. The air heated as described above may be provided to the drum 110 again.

The humidity sensor 140 may detect a humidity of the air flowing from the drum 110. For this, the humidity sensor 140 may be disposed on the flow path formed between the drum 110 and the heat exchanger 130.

This is because it is necessary to detect the humidity of the air flowing from the drum 110, in order to grasp the dried state of the material to be dried, since the flow path is formed in the dryer 100 so that the air discharged from the heat exchanger 130 passes the drum 110 containing the material to be dried and then flow to the heat exchanger 130 again, as described above.

At this time, the air flowing from the drum 110 may contain various foreign materials such as dust or lint separated from the material to be dried, and such foreign materials may cause the problem as described above.

In general, a part of the flow path where the dust or lint is accumulated is a part where the air flow circulates or a flow velocity is low. Accordingly, it is possible to avoid possibility of accumulation of dust or lint by disposing the humidity sensor 140 at the part with a high flow velocity of the air and a straight flow.

Accordingly, according to an embodiment of the disclosure, the humidity sensor 140 may be disposed at a position of the flow path formed between the drum 110 and the heat exchanger 130 with a flow velocity of the air equal to or higher than a predetermined velocity. The predetermined velocity may be equal to or higher than 10 m/s but is not limited thereto.

In addition, according to an embodiment of the disclosure, the humidity sensor 140 may be disposed at a position of the flow path formed between the drum 110 and the heat exchanger 130 with a flow velocity equal to or higher than a predetermined velocity or where the air flows straightly.

The humidity sensor 140 may be disposed to be closer to the heat exchanger 130 rather than the drum 110 in the flow path between the drum 110 and the heat exchanger 130. In this case, a position of the fan 150 may also be closer to the heat exchanger 130, compared to the drum 110. This is because that, in general, the closer to the fan 150, the faster the flow velocity of the air. However, the position of the humidity sensor 140 is not limited thereto, since the position of the fan 150 may vary in the dryer 100 in accordance with the implementation example of the inside of the dryer 100 or whether a positive pressure or a negative pressure is used for generating the flow of the air.

The processor 120 may control general operations of the dryer 100. Particularly, the processor 120 may determine a dried state of the material to be dried contained in the drum 110 based on a humidity detected via the humidity sensor 140.

For example, when the humidity detected via the humidity sensor 140 is lower than a predetermined value, the processor 120 may determine that the drying of the material to be dried is completed. In addition, when a rate of change of the humidity detected via the humidity sensor 140 is lower than a predetermined value, the processor 120 may determine that the drying of the material to be dried is completed.

As described above, when it is determined that the drying of the material to be dried is completed, the processor 120 may control the end of the drying process.

For this, the processor 120 may be connected to various elements included in the dryer 100 to transmit and receive various data and signals. The processor 120 may generate and transmit a control instruction to control various elements included in the dryer 100.

In this case, the processor 120 may operate, for example, an operating system or an application program to control hardware or software elements connected to the processor 120 and perform various data processing and operations. In addition, the processor 120 may load and process an instruction or data received from at least one of other elements on a volatile memory and store various pieces of data in a non-volatile memory.

For this, the processor 120 may be implemented as a dedicated processor (e.g., an embedded processor) for performing the corresponding operations or a generic-purpose processor (e.g., a CPU, a GPU, or an application processor) capable of performing the corresponding operations by executing one or more software programs stored in a memory device.

Figure 4:
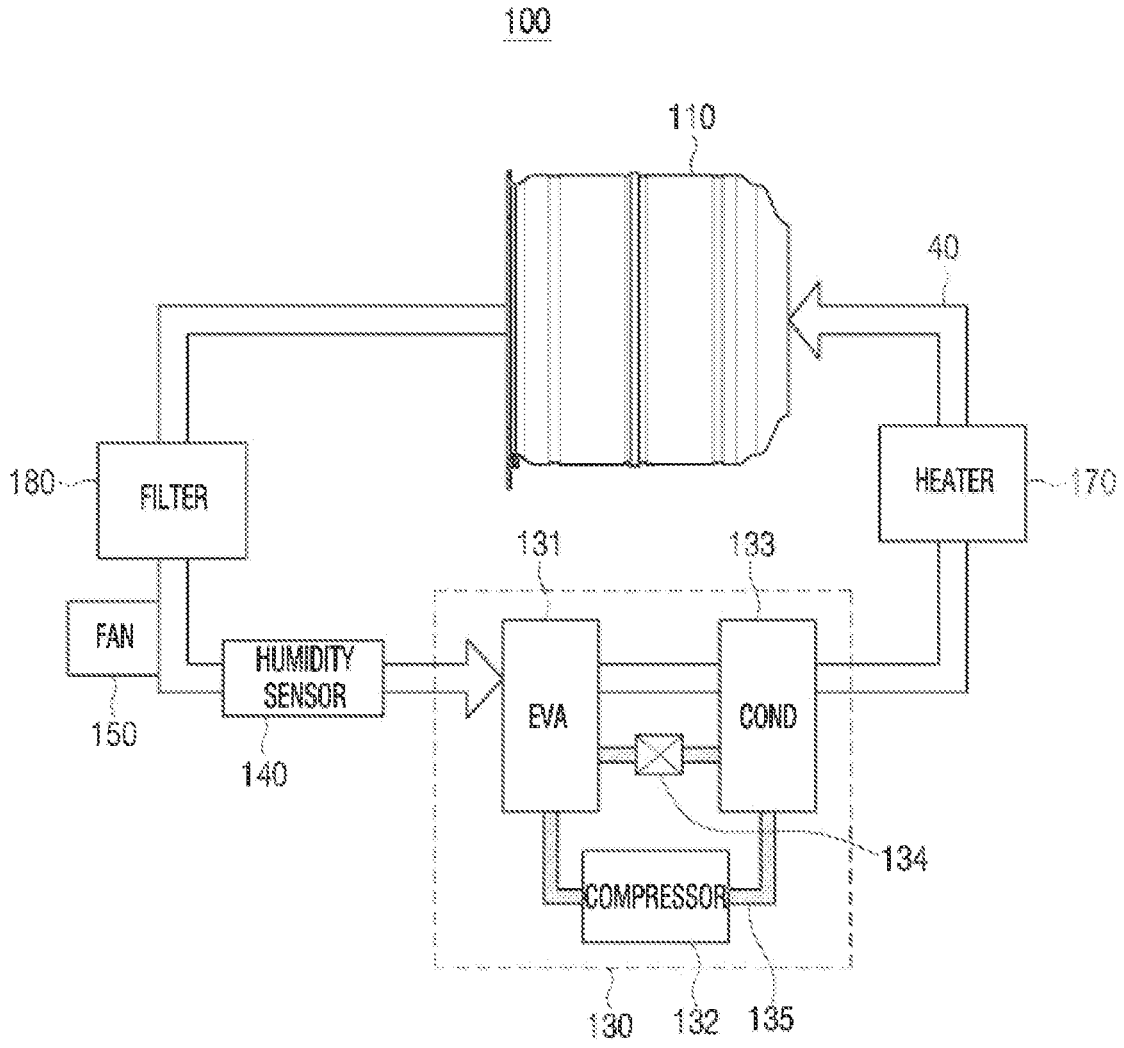
FIG. 4 is a conceptual diagram for illustrating operations of the dryer according to an embodiment.

FIG. 4 is a conceptual diagram for illustrating operations of the dryer 100 according to an embodiment.

The fan 150 may generate a flow of the air in accordance with rotation. In this case, the fan 150 may be driven in accordance with an inverter motor (or motor) (not illustrated) and a rotation rate and a rotation direction of the fan 150 may be changed in accordance with the control of the inverter motor (not illustrated).

Meanwhile, the air discharged from the drum 110 may flow into the drum 110 again through condensation and heating processes, in order to dry the material to be dried contained in the drum 110. In other words, the air may circulate along a flow path 40 in accordance with the fan 150.

The position of the fan 150 illustrated in FIG. 4 is merely an embodiment and the position of the fan 150 is not limited to the position illustrated in FIG. 4.

The dryer 100 may include the heat exchanger 130 condensing and heating the air through a refrigerant. In this case, the refrigerant may flow and circulate in an order of an EVA 131, a compressor 132, a Cond 133, and an expansion unit 134 through a refrigerant pipe 135.

Specifically, in the EVA 131, the refrigerant may be evaporated by absorbing heat. Accordingly, the EVA 131 may condense the circulating air through heat exchange between the refrigerant and the circulating air. At this time, water may be generated due to the condensation of the circulating air and the generated water may be discharged outside of the dryer 100 via a pipe (not illustrated).

Meanwhile, the compressor 132 may compress the refrigerant flowing from the EVA 131 and discharge to the Cond 133.

In this case, the compressor 132 may be driven by the inverter motor (not illustrated) and a rotation rate of the compressor 132 may be changed in accordance with the control of the inverter motor (not illustrated). In other words, a driving frequency of the compressor 132 may be changed. Alternatively, the compressor 132 may be driven by a constant speed type motor (not illustrated) and may be driven to have a constant driving frequency in accordance with the control of the constant speed type motor (not illustrated).

In the Cond 133, the refrigerant may be condensed by emitting heat. Accordingly, the Cond 133 may heat the circulating air through heat exchange between the refrigerant and the circulating air.

The expansion unit 134 may expand the refrigerant flowing from the Cond 133 and discharge the refrigerant to the EVA 131.

Through the operations of the heat exchanger 133 as described above, the process of condensing and heating the air circulating the flow path 40 may be performed and the circulating air may flow into the drum 110 again.

Specifically, the air at a high temperature and a low humidity heated by the Cond 133 may pass through the material to be dried in the drum to become the air at a medium temperature and a high humidity, may be dehumidified through the EVA 131 to become the air at a low temperature and a low humidity, may become the air at a high temperature and a low humidity again by the Cond 133, and then may flow into the drum 110.

The material to be dried may be dried through the circulation process of the air.

Meanwhile, when the material to be dried is sufficiently dried during the circulation process of the air described above according to the drying process, it is necessary to end the drying process. In order to determine whether the material to be dried is sufficiently dried, the humidity sensor 140 may be used in various embodiments of the disclosure.

For this, referring to FIG. 4, the humidity sensor 140 may be disposed on a flow path formed between the drum 110 and the heat exchanger 130.

In order to avoid a possibility of accumulation of dust or lint on the humidity sensor 140, the humidity sensor 140 may be disposed at a position where the flow velocity of the air is equal to or higher than the predetermined velocity, as described above.

In order to further avoid the possibility of accumulation of dust or lint, the humidity sensor 140 may be disposed at a position where the flow velocity is equal to or higher than the predetermined velocity or the air flows straightly.

The position of the flow path formed between the drum 110 and the heat exchanger 130 with a flow velocity of the air equal to or higher than a predetermined velocity or where the air flows straightly may vary depending on the implementation example of the dryer 100 and may be confirmed through a simulation, an experiment, or the like.

Meanwhile, according to an embodiment of the disclosure, a filter 180 for filtering out the foreign materials such as dust or lint in the air may be provided between the drum 110 and the humidity sensor 140. Accordingly, the dust or the lint may be filtered out primarily and accordingly, it is possible to further reduce the possibility of accumulation of the foreign materials on the humidity sensor 140.

In addition, according to an embodiment of the disclosure, a heater 170 for additionally heating the air heated by the Cond 133 may be provided between the Cond 133 and the drum 110. For example, in cold weather such as winter, sufficiently hot air may be difficult to be obtained only by heating of the Cond 133, and accordingly, the air may be additionally heated via the heater 170.

Figure 5:
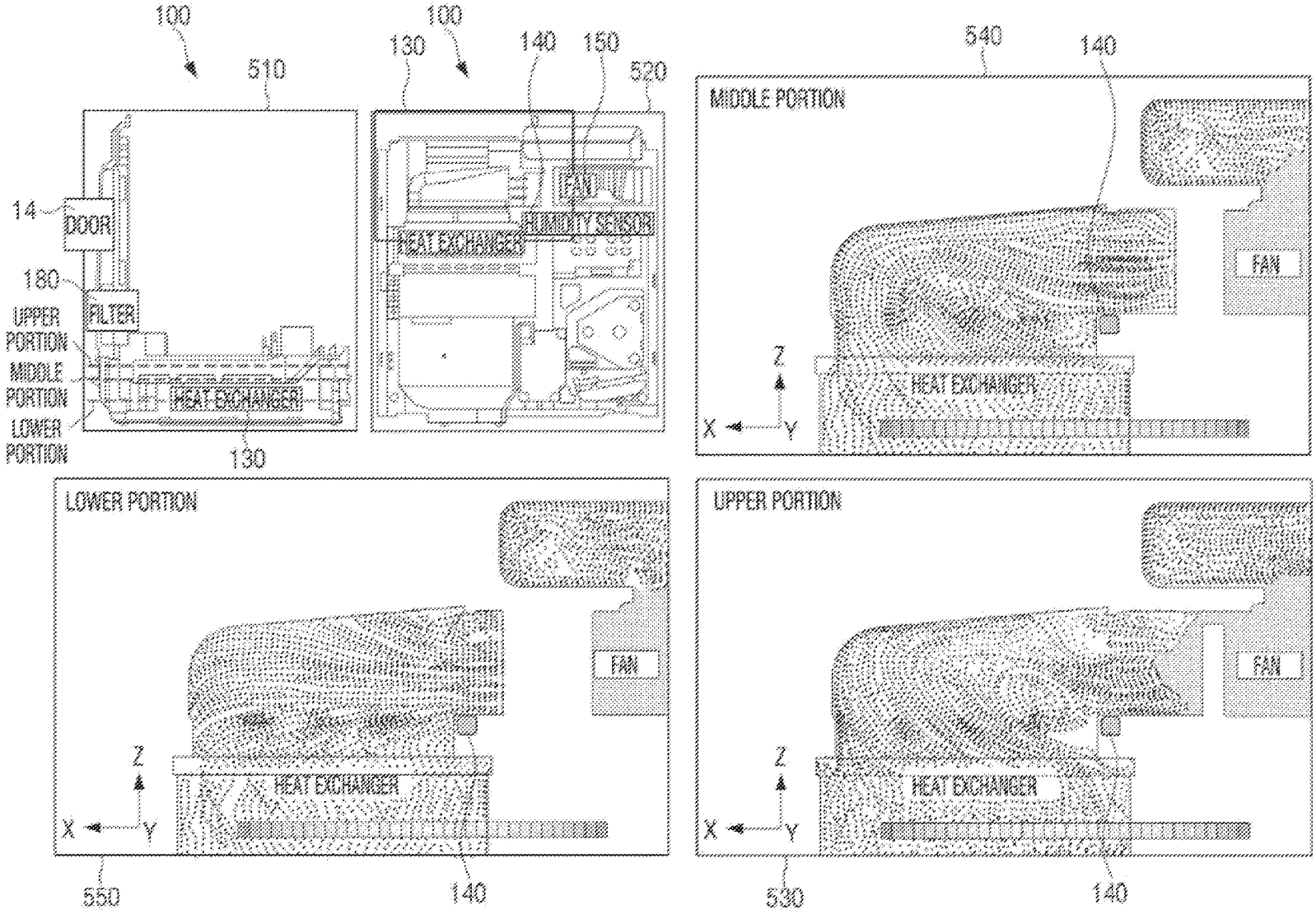
FIG. 5 is an exemplary diagram and experiment data for illustrating a position of a humidity sensor according to an embodiment.

FIG. 5 is an exemplary diagram and experiment data for illustrating a position of the humidity sensor 140 in the dryer 100 according to an embodiment.

Specifically, in FIG. 5, a reference numeral 510 illustrates a side view of the dryer 100, a reference numeral 520 illustrates a cross-sectional view of a middle portion of the dryer 100, and reference numerals 530, 540 and 550 (530 to 550) illustrate results obtained by simulating an air volume on the flow path formed between the drum 110 and the heat exchanger 130.

According to the simulated result of the references 530 to 550 of FIG. 5, it is found that a flow at a high rate equal to or higher than 10 m/s in a straight direction is generated at a part ahead of the heat exchanger 130, in the flow path formed between the drum 110 and the heat exchanger 130.

Accordingly, according to an embodiment of the disclosure, the humidity sensor 140 may be disposed at a part ahead of and adjacent to the heat exchanger 130 in the flow path formed between the drum 110 and the heat exchanger 130.

Figure 6:
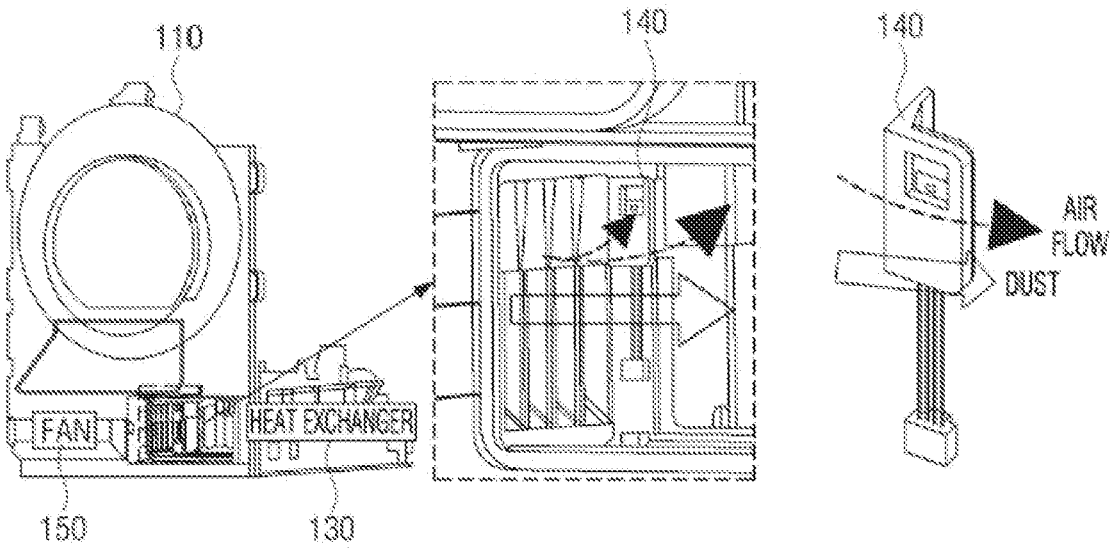
FIG. 6 is a diagram specifically illustrating the position of the humidity sensor in the dryer according to an embodiment.

FIG. 6 is a diagram specifically illustrating the position of the humidity sensor 140 in the dryer 100 according to an embodiment. Referring to FIG. 6, according to the simulated result of FIG. 5, it is found that the humidity sensor 140 may be disposed at the part ahead of the heat exchanger 130 that is a position with a rapid flow in a straight direction in the flow path formed between the drum 110 and the heat exchanger 130.

Accordingly, the dust may not be accumulated on the humidity sensor 140 and may flow along the flow path according to the rapid flow in a straight direction.

Meanwhile, in the examples of FIG. 5 and FIG. 6, the fan 150 merely plays a role of generating a negative pressure in accordance with the rotation to generate the flow of the air circulating the flow path 40, and the air circulating the flow path 40 does not circulate directly through the fan 150.

In FIG. 6, the humidity sensor 140 may be disposed at a position closer to the fan 150 according to an embodiment, but the position of the humidity sensor 140 is not directly dependent to the position of the fan 150 in various embodiments of the disclosure.

Meanwhile, in order to prevent the accumulation of the foreign materials through the rapid flow velocity of the air, a structure for increasing the flow velocity of the air may be applied to the flow path.

Most of foreign materials moves through the flow path with a main flow and the amount of foreign materials is small in the part separated from the main flow. However, the dust may be likely to be accumulated at the part separated from the main flow, since the velocity flow thereof is lower than that in the main flow. Accordingly, by partially applying the structure with a high flow velocity to such a part, it is possible to reduce the possibility of the accumulation of the foreign materials and dispose the humidity sensor 140 at more various positions.

In other words, according to an embodiment of the disclosure, the flow path formed between the drum 110 and the heat exchanger 130 may include a structure for increasing the flow velocity of the air, and the humidity sensor 140 may be disposed at a position with a flow velocity of the air increased by the structure.

In other words, if the structure is not provided, it is the position on the flow path having a flow velocity of the air lower than a predetermined velocity, however, by installing the structure, the flow velocity of the air may be set to be equal to or higher than the predetermined velocity and the humidity sensor 140 may be disposed at the corresponding position.

Figure 7:
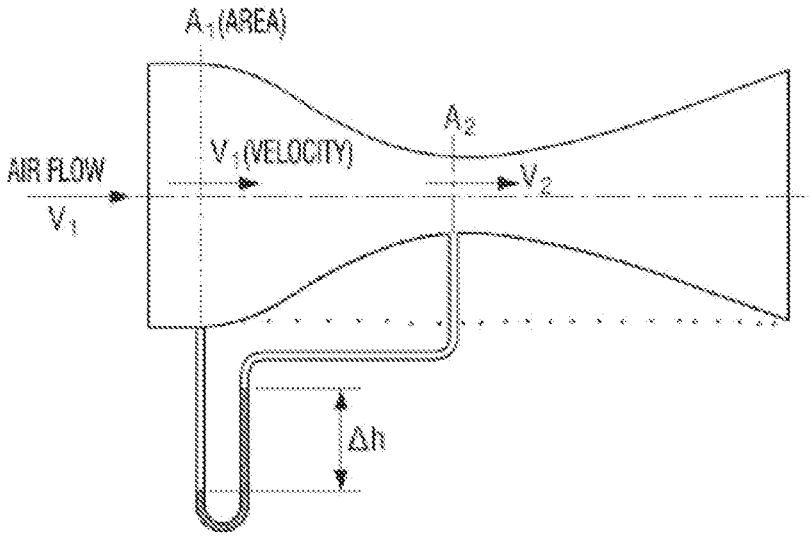
FIG. 7 is an exemplary diagram of a shape of a structure provided on a flow path according to an embodiment.

The structure may be a Venturi tube illustrated in FIG. 7 but is not limited thereto. In the flow path to which the structure having the Venturi tube illustrated in FIG. 7 is applied, the humidity sensor 140 may be disposed at the position where the flow velocity of the air is increased from V1 to V2. Meanwhile, the principle of increasing a flow velocity of a fluidity flowing through the Venturi tube is apparent to those skilled in the art and is not related to the gist of the disclosure, and therefore the specific description thereof will be omitted.

Meanwhile, according to another embodiment of the disclosure, a humidity sensor 140' may be disposed at a position where the foreign materials are easily accumulated because that the flow velocity of the air is low or the flow circulates.

In this case, a flow path through which the air is introduced to the humidity sensor 140' may be formed complicated, thereby preventing a deterioration in performance of the humidity sensor 140' due to the foreign materials.

Figure 8A:
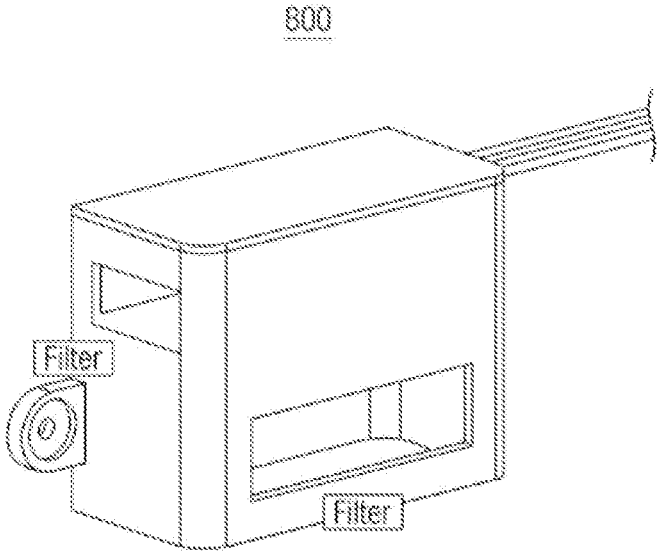
FIG. 8A is an exemplary diagram illustrating an appearance of a humidity sensor according to another embodiment.
Figure 8B:
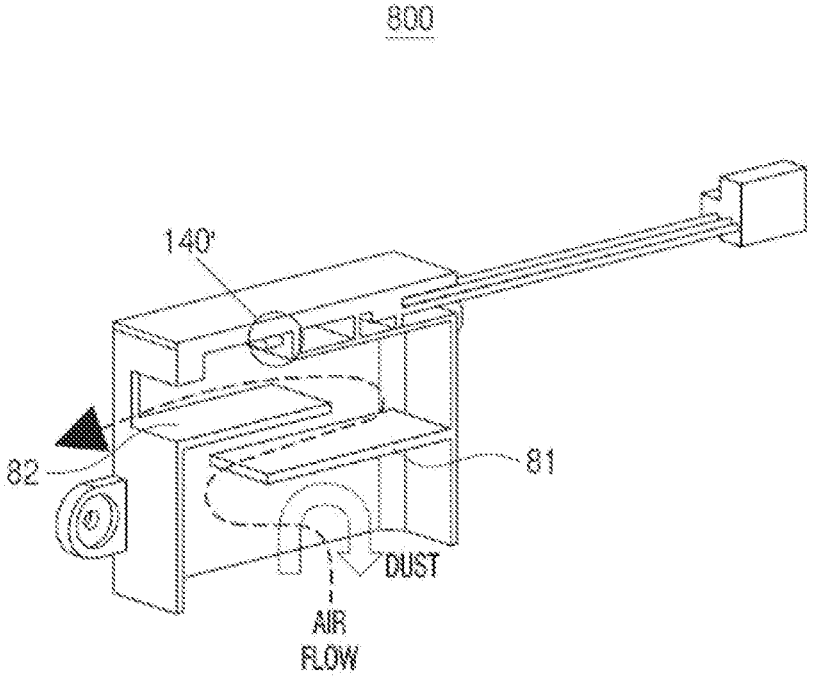
FIG. 8B is an exemplary diagram illustrating an internal structure of the humidity sensor according to the other embodiment.

FIGS. 8A and 8B illustrate an instrument 800 including the humidity sensor 140' which may be disposed at the position where the flow velocity is low or the flow circulates as described above. Specifically, FIG. 8A illustrates an appearance of the instrument 800 and FIG. 8B illustrates an internal structure of the instrument 800.

Referring to FIG. 8B, the instrument 800 including the humidity sensor 140' may be manufactured as a structure which transfers moisture generated in the material to be dried to the humidity sensor 140' by diffusion and filters out heavy foreign materials by shielding films 81 and 82.

The instrument 800 may be installed at a position on the flow path 40 through which the air flows upwards from the bottom, in order to maximize the effect of preventing the accumulation of foreign materials.

Meanwhile, referring to FIG. 8A, in the instrument 800, three holes in total including a bottom surface for introducing the air and two portions indicated as the filter may be observed. An air permeable waterproofing filter (e.g., Gore-Tex), through which only moisture is able to pass, may be applied to two holes indicated as the Filter and the hole on the bottom surface is open, to cause the foreign materials to naturally drop to the bottom. Accordingly, it is possible to maximize the effect of preventing the accumulation of the foreign materials while maintaining the performance of the humidity sensor 140'.

Figure 9:
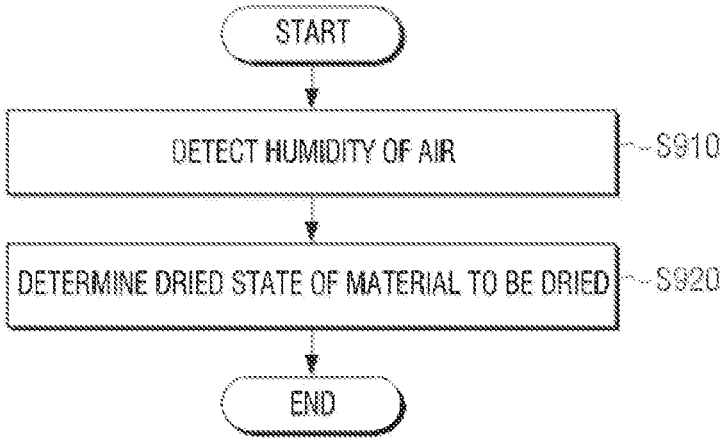
FIG. 9 is a flowchart illustrating a method for controlling a dryer according to an embodiment.

FIG. 9 is a flowchart illustrating a method for controlling the dryer 100 according to an embodiment. In the dryer 100, the flow path may be formed so that the air discharged from the heat exchanger 130 flows into the heat exchanger 130 again via the drum 110 and the humidity sensor 140.

Referring to FIG. 9, the dryer 100 may detect a humidity of the air flowing from the drum 110 containing the material to be dried through the humidity sensor 140 (S910). The humidity sensor 140 may be disposed at the position where the flow velocity of the air equal to or higher than the predetermined velocity in the flow path formed between the drum 110 and the heat exchanger 130.

The humidity sensor 140 may be disposed at the position of the flow path formed between the drum 110 and the heat exchanger 130 where the air flows straightly.

In addition, the humidity sensor 140 may be disposed at the position closer to the heat exchanger 130 in the flow path formed between the drum 110 and the heat exchanger 130.

Meanwhile, according to an embodiment of the disclosure, the flow path formed between the drum 100 and the heat exchanger 130 may include a structure for increasing the flow velocity of the air. Accordingly, the humidity sensor 140 may be disposed at the position with the flow velocity of the air increased by the structure. The structure may have a shape of the Venturi tube. However, there is no limitation thereto.

The dryer 100 may filter out dust or lint contained in the air flowing from the drum 110 using the filter 180. Accordingly, the dryer 100 may detect a humidity of the air of which dust or lint is filtered out.

Meanwhile, the dryer 100 may additionally heat the air heated by the heat exchanger 130 using the heater 170.

Accordingly, the dryer 100 may determine a dried state of the material to be dried based on the detected humidity (S920). Specifically, when the humidity detected via the humidity sensor 140 is lower than the predetermined value, the dryer 100 may determine that the drying of the material to be dried is completed. In addition, when the rate of change of the humidity detected via the humidity sensor 140 is lower than a predetermined value, the dryer 100 may determine that the drying of the material to be dried is completed.

As described above, when it is determined that the drying is completed, the processor 120 may end the drying process of the dryer 100.

According to various embodiments of the disclosure described above, it is possible to accurately determine the dried state of the material to be dried using the humidity sensor. In addition, it is possible to overcome a positional limitation of an electrode sensor using the humidity sensor and solve a problem occurring when applying the humidity sensor.

Various embodiments of the disclosure may be implemented as software including instructions stored in machine (e.g., computer)-readable storage media. The machine is a device which invokes instructions stored in a storage medium and is operated according to the invoked instructions, and may include the dryer 100 according to the disclosed embodiments.

In a case where the instruction is executed by a processor, the processor may perform a function corresponding to the instruction directly or using other elements under the control of the processor. The instruction may include a code made by a compiler or a code executable by an interpreter. The machine-readable storage medium may be provided in a form of a non-transitory storage medium. Here, the "non-transitory" storage medium is tangible and may not include signals, and it does not distinguish that data is semi-permanently or temporarily stored in the storage medium.

According to an embodiment, the methods according to various embodiments disclosed in this disclosure may be provided to be included in a computer program product. The computer program product may be exchanged between a seller and a purchaser as a commercially available product. The computer program product may be distributed in the form of a machine-readable storage medium (e.g., compact disc read only memory (CD-ROM)) or distributed online through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

Each of the elements (e.g., a module or a program) according to various embodiments described above may include a single entity or a plurality of entities, and some sub-elements of the abovementioned sub-elements may be omitted or other sub-elements may be further included in various embodiments. Alternatively or additionally, some elements (e.g., modules or programs) may be integrated into one entity to perform the same or similar functions performed by each respective element prior to the integration. Operations performed by a module, a program, or other elements, in accordance with various embodiments, may be performed sequentially, in a parallel, repetitive, or heuristically manner, or at least some operations may be performed in a different order, omitted, or may add a different operation.

The above description is merely a description of the technical spirit of the disclosure and various changes and modifications may be performed by those skilled in the art within the scope of the fundamental feature of the disclosure. The embodiments of the disclosure are not to limit but to describe the technical spirit of the disclosure and the scope of the technical spirit of the disclosure is not limited by the embodiments. Therefore, the scope of protection of the disclosure should be interpreted by the appended claims and all of the technical spirits in the same scope should be interpreted to be included in the scope of a right of the disclosure.

What is claimed is:

1. A dryer comprising:

a heat exchanger configured to remove moisture from air flowing, and heat and discharge the moisture-removed air;

a drum to contain a material to be dried;

a humidity sensor configured to detect a humidity of air flowing from the drum;

a fan configured to generate a flow along a flow path that is formed so that the moisture-removed air discharged from the heat exchanger flows to the heat exchanger subsequent to passing through the drum and the humidity sensor; and a processor configured to determine a dried state of the material to be dried based on the humidity detected through the humidity sensor, wherein the humidity sensor is disposed at a position where a flow velocity of air is equal to or higher than a predetermined velocity along the flow path which is formed between the drum and the heat exchanger.

2. The dryer according to claim 1, wherein the position of the humidity sensor is where there is a straight air flow along the flow path formed between the drum and the heat exchanger.

3. The dryer according to claim 1, wherein the position of the humidity sensor is closer to the heat exchanger than the drum along the flow path formed between the drum and the heat exchanger.

4. The dryer according to claim 1, wherein the flow path formed between the drum and the heat exchanger comprises a structure for increasing the flow velocity of the air, and wherein the position of the humidity sensor is where the flow velocity of the air is increased by the structure.

5. The dryer according to claim 4, wherein the structure has a shape of a Venturi tube.

6. The dryer according to claim 1, further comprising:

a filter to filter out dust or lint contained in the air flowing from the drum.

7. The dryer according to claim 1, further comprising:

a heater for additionally heating the air heated by the heat exchanger.

8. The dryer according to claim 1, wherein the processor is configured to:

based on the humidity detected through the humidity sensor being lower than a predetermined value or a rate of change of the humidity detected through the humidity sensor being lower than a predetermined value, determine that drying of the material to be dried is completed.

9. A method for controlling a dryer in which a flow path is formed so that air discharged from a heat exchanger flows to the heat exchanger subsequent to passing through a drum and a humidity sensor, the method comprising:

detecting, through the humidity sensor, a humidity of air flowing from the drum which is configured to contain a material to be dried; and determining a dried state of the material to be dried based on the humidity detected through the humidity sensor, wherein the humidity sensor is disposed at a position where a flow velocity of the air is equal to or higher than a predetermined velocity along the flow path which is formed between the drum and the heat exchanger.

10. The method according to claim 9, wherein the position of the humidity sensor is where there is a straight air flow along the flow path formed between the drum and the heat exchanger.

11. The method according to claim 9, wherein the position of the humidity sensor is closer to the heat exchanger than the drum along the flow path formed between the drum and the heat exchanger.

12. The method according to claim 9, wherein the flow path formed between the drum and the heat exchanger comprises a structure for increasing the flow velocity of the air, and wherein the position of the humidity sensor is where the flow velocity of the air is increased by the structure.

13. The method according to claim 12, wherein the structure has a shape of a Venturi tube.

14. The method according to claim 9, further comprising:

filtering out dust or lint contained in the air flowing from the drum through a filter, wherein the detecting comprises detecting a humidity of the air of which dust or lint is filtered out.

15. The method according to claim 9, further comprising:

additionally heating the air heated by the heat exchanger through a heater.

16. The method according to claim 9, wherein the determining comprises:

based on the humidity detected through the humidity sensor being lower than a predetermined value or a rate of change of the humidity detected through the humidity sensor being lower than a predetermined value, determining that drying of the material to be dried is completed.

* * * * *